US005392617A

United States Patent [19]

Baldwin

[11] Patent Number: 5,392,617

[45] Date of Patent: Feb. 28, 1995

[54] PIERCED EARLOBE SHIELD

[76] Inventor: Dianne K. Baldwin, 37 Whispering Hills Pl., Chester, N.Y. 10918

[21] Appl. No.: 38,196

[22] Filed: Mar. 22, 1993

Related U.S. Application Data

[63] Continuation-in-part of Ser. No. 775,595, Oct. 15, 1991, abandoned.

[51] Int. Cl.[6] ..... A44C 7/00

[52] U.S. Cl. ..... 63/12

[58] Field of Search ..... 63/1, 2, 12, 13, 14.1; 24/705

[56] References Cited

U.S. PATENT DOCUMENTS

| | | | |
|---|---|---|---|
| 113,031 | 3/1871 | Edge | 63/12 |
| 161,853 | 4/1875 | Baker | 52/12 |
| 2,691,846 | 10/1954 | Frouling | 63/12 |
| 4,067,341 | 1/1978 | Ivey | 63/12 |
| 4,089,189 | 5/1978 | Verducci | 63/12 |
| 4,761,971 | 8/1988 | Freier | 63/12 |
| 4,829,788 | 5/1989 | DiDomenico | 63/12 |

FOREIGN PATENT DOCUMENTS

| | | | |
|---|---|---|---|
| 276197 | 7/1988 | European Pat. Off. | 63/12 |
| 2239781 | 7/1991 | United Kingdom | 63/12 |
| 2244636 | 12/1991 | United Kingdom | 63/12 |
| 2249252 | 5/1992 | United Kingdom | 63/12 |
| 8809134 | 12/1988 | WIPO | 63/12 |

*Primary Examiner*—Flemming Saether
*Attorney, Agent, or Firm*—Samuel Shipkovitz

[57] ABSTRACT

A jewelry article comprising a sleeve having a groove at one end and a central bore hole going substantially therethrough the sleeve, and a face piece having at least one tongue and spring bias means, which when a tongue of the face piece is inserted into the groove of the sleeve secures the two together such that when an earring post is inserted into the borehole of the sleeve the tongue will, under the spring bias means, secure the earring post to the sleeve. The sleeve and face are made of inert materials. If the tongue is indented from the plane of the face piece then when the face piece is tilted away (i.e., at an acute angle to the axis of the central borehole from being perpendicular to the axis of the bore hole, then even larger diameter earring posts can be entered. The jewelry article will upon the above-described assembly prevent irritation and inflammation due to contact from non-hypo-allergenic and hygroscopic materials with the skin because the earring post never touches the skin due to the sleeve barrier.

7 Claims, 2 Drawing Sheets

PIERCED EARLOBE SHIELD

This is a continuation-in-part of application Ser. No. 775,595, filed Oct. 15, 1991, by the same inventor, Dianne K. Baldwin which is now abandoned.

BACKGROUND OF THE INVENTION

1. Field of the Invention

This invention relates to pierced earrings and to the matter of providing a barrier between earlobes and pierced earrings of the variety which are manufactured from non-hypo-allergenic and hygroscopic materials.

2. Discussion of the Prior Art

Pierced earrings, as is well known, consist of three sections. The first section is a 'face' configuration which rests against the front of the earlobe. The second section is the 'post' configuration which is attached to the 'face'; which post extends completely thru the pierced opening in the earlobe. The third section is the 'clasp' configuration which grips the 'post' behind the earlobe and holds the earring firmly in place.

Because of the rising costs of precious metals a great percentage of pierced earrings are manufactured from metals containing materials which are neither non-allergenic nor non-hygroscopic. As a consequence to wearing pierced earrings made from such materials, many wearers suffer the problem of earlobe infection and inflammation.

In an effort to minimize the problem of infection and inflammation existing with the prior art some pierced earrings have been manufactured with hypo-allergenic and non-hygroscopic posts. However, while that might reduce the inflammation inside the pierced opening in the earlobe it does not reduce the problem at the front or back of the earlobe.

Other inventions have gone a step further by providing a non-hypo-allergenic barrier between the 'face' and the 'post' of the non-hypo-allergenic and hygroscopic pierced earrings. However, such inventions have the disadvantage of being awkward to handle and are easily broken. The main disadvantage of such inventions is that while they may provide some protection for the front of the earlobes and for the insides of the pierced holes in the earlobes, they do not provide protection for the back of the earlobe because such inventions rely on the non-hypo-allergenic and hygroscopic clasps of the non-hypo-allergenic and hygroscopic pierced earrings to secure them in place in back of the ears. Such clasps continue to make contact with the skin in back of the ear thus offering no protection against infection or inflammation in that area.

Another problem associated with the prior art is the damage caused by the tearing of earlobes due to the heavy weight of some pierced earring designs. Such damage often necessitates surgical repair work by medical practitioners. As a result of such circumstances many wearers are unable to wear pierced earrings over again.

OBJECTS & SUMMARY OF THE INVENTION

It is an object of the present invention to provide a 'face' configuration which acts as a barrier between the skin of the front of the earlobe and the 'face' configuration of the non-hypo-allergenic and hygroscopic pierced earrings effectively overcoming the problems existing with the prior art. The materials used in this part of the invention are precious metals of gold and platinum.

It is also an object of the present invention to provide a tubular hollow post which acts as a barrier between the inside of the pierced hole in the earlobe and the post of the non-hypo-allergenic and hygroscopic earring effectively overcoming the problems existing with the prior art. The materials used in this part of the invention are precious metals of gold and platinum.

It is a further object of the invention to provide a barrier in back of the earlobe between the skin and the post of the non-hypo-allergenic and hygroscopic earring which post would normally make contact with the skin in back of the earlobe and cause the irritation and inflammation problems existing with the prior art. The materials used in this part of the invention are precious metals of gold and platinum.

The clasp used to hold the present invention securely in place in back of the earlobe is a clasp used in the prior art but which, in order to compliment the present invention, is manufactured in precious metals of gold and platinum.

Another object of the invention is to provide a hollow ornamental pierced earring which by its technical design provides the simple means to easily insert and securely hold the post of any other pierced earring.

Another object of the present invention is to minimize the damage of tearing caused to earlobes by thin wire posts which support extremely heavy pierced earrings of the prior art.

DESCRIPTION OF THE DRAWING

In the drawing which illustrates the preferred mode presently contemplated for carrying out the present invention.

The present invention thereby provides entry and support for a non-hypo-allergenic and hygroscopic earring post of the prior art.

Figure 4:
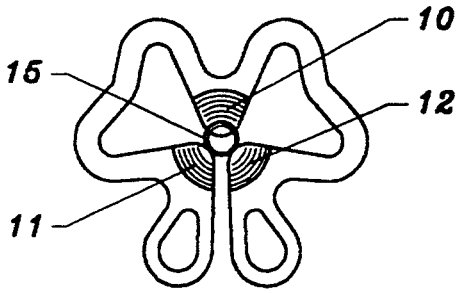

FIG. 4 is an enlarged frontal view of the face piece of the present invention, showing how a tongue, usually the tongue opposite to the open entry path, sits at least partially inside the groove of the tubular hollow post/-sleeve/cannula, while the other tongues, such as 11 and 12 of the core, rest with spring action bias pressure against the sides of the tubular hollow post or sleeve.

Figure 5:
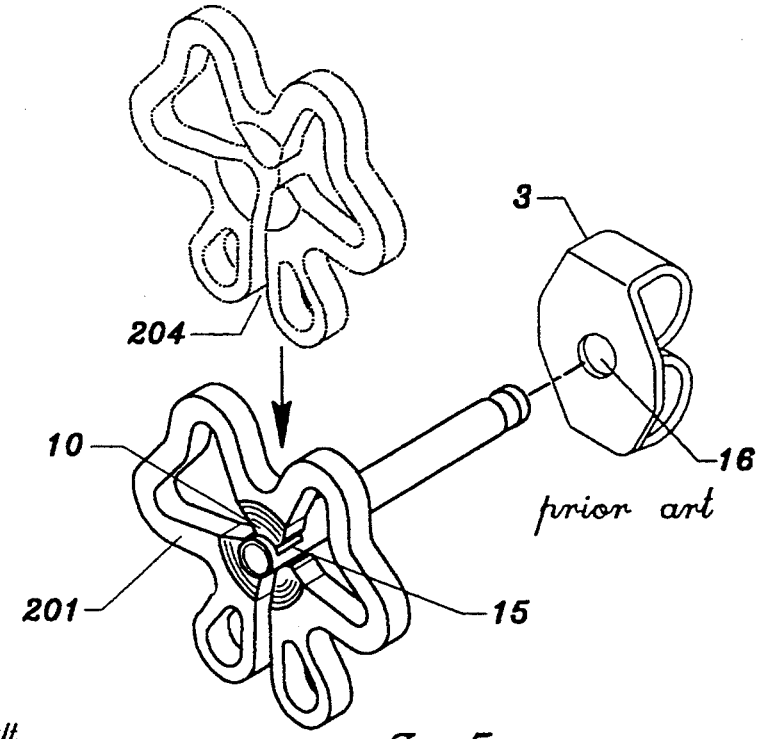

FIG. 5 is an enlarged perspective view showing the usual method of installation of the present invention, of the face piece being mated to the sleeve by having the face piece being pushed onto the groove end of the sleeve by way of the open entry path opening 204 of the face piece, or alternatively, the movement could be the groove end of the sleeve moved through said open entry path opening of the face piece until the sleeve is in the core aperture 203 between the tongues of the core of the face piece, with one tongue entering the groove of the sleeve.

A clasp of the type of the prior art with perhaps an enlarged aperture is shown. The clasp is fitted over the non-groove end of the tubular hollow post/sleeve, usually behind the ear/body part of the wearer, i.e., not the front nor outer-facing side of the ear or body part.

Figure 1:
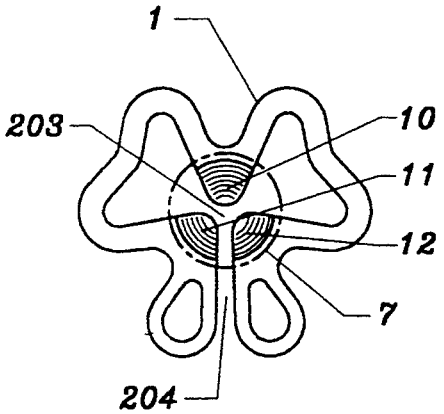
FIG. 1 shows at FIG. 1(*a*) an enlarged frontal view and FIG. 1(*b*) side view of a resilient 'face' piece embodiment in accordance with the present invention. Note that the inner radial region/core in this embodiment is further from the reader than the outer-radial region.
Figure 1:
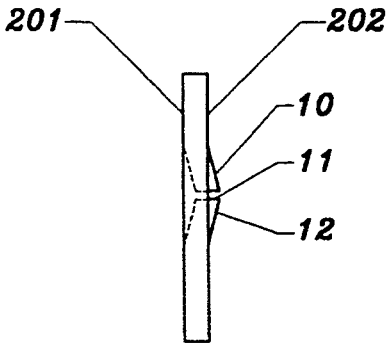
Figure 6:
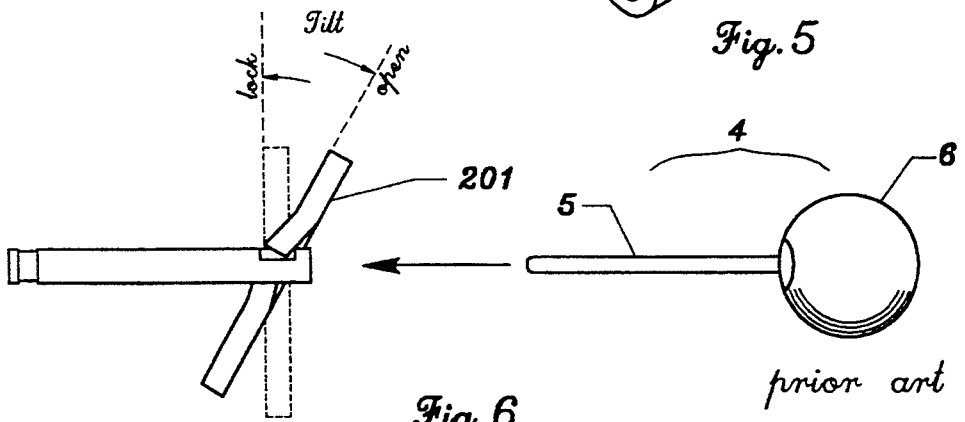

FIG. 6 is an enlarged side view showing the "locked" (perpendicular) and "open" (titled) positions of the face piece with respect to the sleeve and its groove, disclosing the mechanical function of operation of the invention. The "open" position provides an entry for the insertion of the post of an earring of the prior art. once the post of an earring of the prior art is fully inserted into the cavity/borehole of the sleeve, the face piece of FIG. 1 is tilted back into the upright/perpendicular-to-the-axis of the sleeve position into the "locked" position, so that tongue 10 will, with the spring bias provided by the rest of the face piece, here including tongues 11,12, firmly sits against and hold the earring post. Said spring bias firmly secure the inserted earring post of the prior art to the sleeve/tubular hollow post of the present invention.

FIG. *7a* is an enlarged sectional side view of the present invention with the face piece in the "open" (tilted) position, containing, after insertion, an earring post of the prior art.

FIG. *7b* is an enlarged sectional side view of the present invention in the "locked". The sleeve aperture/openly available diameter in the "open" position is greater than when the face piece is in the "locked" position. The indented-core of the face piece (indented side) is-closest-to the groove end of the sleeve, i.e. (side 201 of the face is closest to/facing the groove end of the sleeve), and thus permits use of even larger diameter earring posts than if the face piece did not have an indented core (see FIG. 6).

DESCRIPTION OF A PREFERRED EMBODIMENT

In reference to details of the drawings, FIG. 1 shows a preferred embodiment of a face piece 1 of the present invention. The core 7 of the face piece comprises three tongue sections 10, 11, and 12. The core is shown indented "inward" (away from the reader) from the outer radial portions of the face piece as viewed in FIG. 1, as clearly shown in the side view. The face piece is resilient and made from hypo-allergenic and non-hygroscopic gold or platinum.

Figure 2:
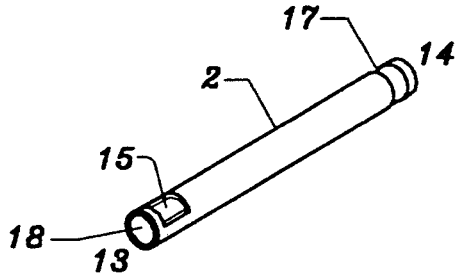
FIG. 2 shows an enlarged perspective view of a hollow tubular earring post or sleeve/cannula in accordance with the invention having a small notch or groove on one area of the annulus of the tube or sleeve in close proximity to the front (with respect to the face of the wearer) end of the sleeve in accordance with the present invention.

FIG. 2 shows the other component of the invention, a tubular hollow post or sleeve/cannula 2 being open(-hollow), 18, at least at one end 13, and having a small groove or notch 15 at a portion of the annulus at this groove end 13 (end closest to the groove) of said sleeve, in close proximity to said front (publicly seen side of the ear) or groove end 13. An annular depression 17 may be near the other end, the non-groove-end 14, to permit clasps of the prior art to be optionally used (shown in FIG. 5). The sleeve may be described as a shield protecting the wearer from the allergenic materials of earrings.

The hollow post of the shield sleeve 2 of FIG. 2 is made from hypo-allergenic and non-hygroscopic gold or platinum to prevent inflammation to the wearer of the earring posts of the prior art. The axis of the sleeve (cylinder shown) is a line parallel to the length of the sleeve.

Figure 3:
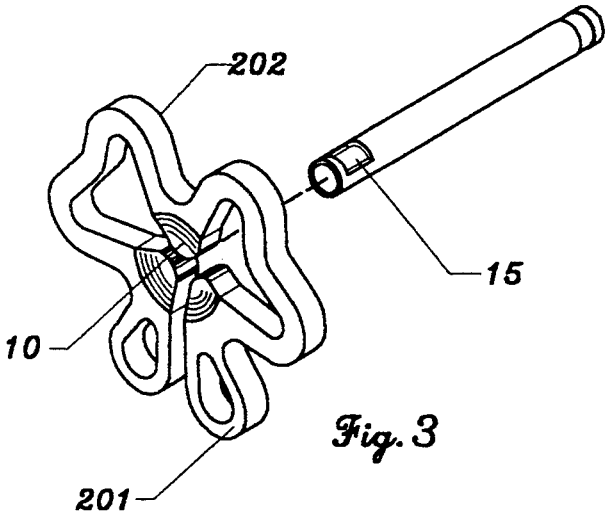
FIG. 3 is an enlarged perspective view of the invention showing the relationship of the sleeve of FIG. 2 and its part annular groove at one end, to the 'face' piece of FIG. 1, having the side of the face which protrudes the face shown closest to the groove end of the sleeve (not installed). Please note that the face piece is usually not installed by frictional entry of the sleeve directly through the opening in the inner-radial core (core aperture) of the face, but usually installed by slipping the face piece vertically downward by the wearer such that the opening/open entry path 204 between two tongues (say 11,12) (or spring bias means) of the core of the face is moved to permit entry of the sleeve such that its groove faces the center 203 of the core aperture, with said sleeve slid into and through the open entry path of the face piece until the sleeve enters the open area/core aperture 203 between said tongues or spring bias means. The sleeve and/or the face piece are then moved with respect to each other until a tongue enters the groove at the groove end of the sleeve. See FIG. 5.

FIG. 3 is an enlarged perspective view of the invention showing the relationship of the shield/sleeve 2 of FIG. 2 with its groove 15 at one end 13—to: the face piece 1 of FIG. 1 having the side of the face which protrudes the face positioned (pre-installation) closest to the groove end 13 of the sleeve (again noting that this is pre-installation positioning); i.e. how the wearer probably hold the face piece when picking it up with respect to the groove end. Please note that the face piece is usually not installed by frictional entry of the sleeve directly through the core aperture or opening 203 in the inner radial/core of the face, but usually installed by slipping the face piece vertically downward such that the open-entry path opening 204 between the spring bias, here tongues 11,12 of the core, is moved such that the sleeve 2, with groove 15 facing (opposed(vertically upward for normal wearer installation)) the center 203 of the core, is slid into and through the open entry path/opening 204 until the sleeve 2 enters the core aperture open area 203 of the core, between the tongues 11,12 of the core. The sleeve and/or face are then moved with respect to each other until one of the tongues, say 10, enters groove 15. See FIG. 5.

The present invention thereby provides entry and support for a non-hypo-allergenic and hygroscopic earring post of the prior art. Tongues 11,12 need not be tongues, but the face requires at least one tongue combined with spring bias means in order to have the face put pressure on the sleeve to secure the sleeve to the face and (vice versa) once tongue 10 is in the groove 15. The pressure must be enough to hold a tongue in position in the groove once an earring post of the prior art is inserted. See below.

FIG. 4 is an enlarged frontal view of the face piece of the present invention, showing how a tongue, usually tongue 10 opposite (but not necessarily so) the open entry path opening 204. sits at least partially inside groove 15 of the tubular hollow post/sleeve 2, while the other tongues, such as 11,12 of the core, rest with spring action bias pressure against the sides of the tubular hollow post or sleeve 2. Note the core area 7, including the tongues, is shown indented (inward/away with respect to the viewer) with respect to the plane of the outer radial region (i.e. other than region 7) of the face piece 1). (Concentric circles indicate distance further away from the paper in 3-D; See French, *Engineering Drawing*, various edition). It is clear that the "width" of opening 204 at the inner radial portion of said opening (i.e. substantially at core aperture 203) is less than the diameter of the sleeve 2 in order to cause spring bias action once the sleeve is inserted into the core, and also that the diameter of the portion of core aperture opening 203 determined when a tongue enters groove 15 is less than the outside diameter of sleeve 2, in general, so that the face will provide spring bias to the sleeve to keep a tongue in place in said groove. The spring bias being sufficient to perform the securing of the face piece to the sleeve also when an earring post of the prior art is inserted into the hollow 18 of sleeve 2. See infra.

FIG. 5 is a perspective view of the present invention showing a usual method of the face piece 1 being mated to sleeve 2 by having the face piece being pushed into groove end 13 of the sleeve by way of opening/open entry path 204 of the face piece and adjusted until tongue 10 enters groove 15, or another tongue, if desired, enters groove 15, or a desired tongue enters another groove if there are a plurality of grooves at end 13. Normally, the front or outer-facing side of the earlobe is closest to the face piece 2 while the back or inward-facing side of the earlobe is closest to the non-groove end of the sleeve; or usual end of the sleeve to which the clasp 3 is secured.

Normally the wearer will be standing and will push face piece 1, with nonprotruding side 201 of the face piece (indented inside) facing and closest to groove end 13, downward vertically for normal human wearers, via open entry path 204 over sleeve 2 at said groove end 13, until a tongue, usually tongue 10, although, as stated above, any desired tongue could be used, is inserted into groove 15, and will be held there in place thereafter by the spring bias provided by the (usually a plurality of tongues) rest of the face piece applying said bias on sleeve 2.

Alternatively, groove 13 of the sleeve 2 could be moved through opening 204 of face piece 1 until sleeve 2 is between the tongues of the core of the face piece. Then the sleeve and/or face piece are rotated with respect to each other until tongue 10 or another desired tongue enters groove 15.

A clasp 3 of the type of the prior art with perhaps an enlarged aperture 16 would be or could be clasped to the non-groove end 14 of sleeve 2 to secure the earring assembly at the usual back side of the ear or body part. An annular depression 17 could be made near the non-groove end 14 to facilitate securing clasps of the prior art. In any event the clasp prevents the earring sleeve 2 and face piece 1 from coming out of the usual front side of the ear or body part by securing the assembly at the back side of the ear or body part.

In reference to the mechanics of inserting the earring post into sleeve 2, the face piece 1 is first mated to the sleeve 2, as stated above, so that side 201 of the face is closer to groove end 13 and a tongue enters a desired groove. As will be shown in FIGS. 6 and 7 the face piece is moved away from the usually vertical, but at any rate away from being in a plane perpendicular to the axis of the sleeve, so as to allow easy entry of an earring post 5 of various diameters of such post 5 into hollow 18 of said sleeve/tubular hollow post 2 (via the opening at groove end 13), and made even easier by the indented core of the face piece as will be shown. (indented: from view of: void closest, protrusions further away from viewer)

This adjustment process is shown in action in FIG. 3 where the top of the face having element 10 is tilted away from the reader and the bottom of the face, having elements 11,12 is shown tilted toward the reader. In other words, the tilting of the face piece while one of the three tongues 10, 11, or 12 is in the groove 15 causes the area perpendicular to the axis of the pipe, i.e., parallel to a cross section of the pipe, to increase, and thus such tilting allows earring posts of various cross sections, (i.e., areas of cross section) to enter the cavity of the hollow pipe post of shield of FIG. 2. As shown without exaggeration in said FIG. 3, the face may be stamped such that the inner-radially portions are pushed back from the outer-radially portions of said face. This is shown in exaggerated cross section in FIGS. 1*b*, 6, 7*a*. This allows an even further tilting of the face than if the face were singularly planar and thus allows even larger posts to enter the hollow post or shield shown in FIG. 2. When the hand pressure tilt is ended, the tongue (10, 11 or 12) which has entered groove 15 has still enough pressure caused by the pressure on the shield of the tongues which are not in the groove that significant frictional pressure exists sufficiently to reasonably hold and secure the post in the shield (hollow post) to prevent it from moving or falling out.

Figure 7A:
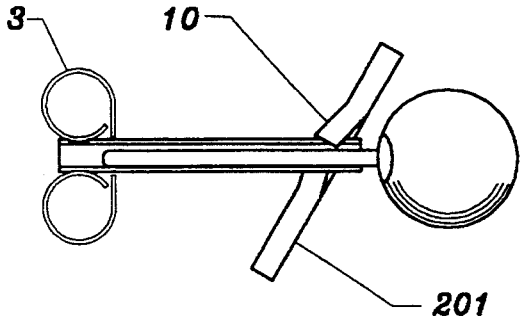

FIG. 6 is an enlarged sectional side view of the "locked" and "open" positions of the face piece 1, showing the mechanical function of operation of the invention. The "open" or tilted position, further shown in section in FIG. 7*a*, provides an entry for the insertion of the post 5 of earring 4 of the prior art into hollow 18. Note that due to side 201 of face piece 1 facing/closest to groove end 13, and the core of the face being indented, the tilting of the face piece into the "open" position gives a larger opening for passage of larger diameter earring posts 5 than if the core of the face piece were not intended. As stated, this is clearly shown in FIG. 7*a*. Note that the indentation/protrusion/side 202 is further from groove end 13 than void side 201.

Once the post 5 of the earring 4 of the prior art is fully inserted into the hollow cavity 18 of the sleeve 2, the face piece 1 of FIG. 1 is tilted back and into the substantially upright/perpendicular-to-the-axis-of-the-sleeve position, i.e. into the "locked" position, so that a tongue, usually inserted into groove 15, tongue 10, will, with the spring bias pressure provided by the rest of the face, firmly sit against the post 5, and with said spring bias pressure firmly secure the inserted earring post 5 of the prior art with respect to the sleeve/tubular hollow post 2 of the present invention.

Figure 7B:
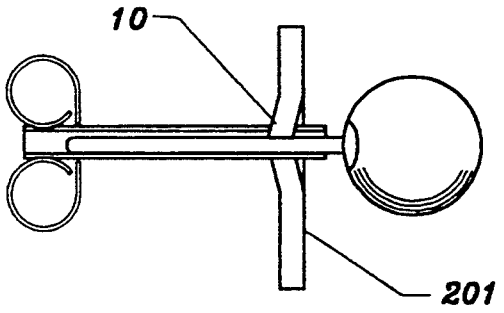

As noted above, FIG. 7*a* is an enlarged sectional side view of the present invention in the "open" position of the face, containing an earring post of the prior art in the sleeve. FIG. 7*b* is an enlarged sectional side view of the present invention in the "locked" position showing that the sleeve's available internal aperture diameter substantially at the groove in the "open" position is greater than when in the "locked" position. The indented side of the core of the face when placed closest to the groove end of the sleeve (i.e. side 201 closer to the groove end than side 202) permits even larger diameter earring posts 5 than if the face piece did not have an indented core (see FIG. 6 as well as FIG. 7*a*). (core 7 being the inner radial area of the face, as described above, containing at least one tongue and spring bias means which could be additional tongues 11, 12 as well as a core aperture 203 (with access to it by means of open entry path 204)).

Note that in the "locked" position the inserted tongue, kept in place by the spring bias of the other parts of the face, puts bias against the earring post 5 itself, and thus secures the earring post 5 to the sleeve 2. (The clasp 3 prevents the assembly from falling through the body hole at the other end.) (The assembly thus comprising the face, sleeve, and earring 4 having post 5, but not the clasp.)

When the non-hypo-allergenic earring post 5 is inserted into the sleeve/tubular hollow post 2, the core section's inserted tongue, say 10, becomes firmly positioned against the inserted non-hypo-allergenic and hygroscopic post 5, and thereby supports and holds it steadfastly. The non-hypo-allergenic and hygroscopic post 5 is completely encased by the tubular hollow post/sleeve 2 of the present invention (when the post is properly/fully inserted). When the assembly of the earring post 5, sleeve 2 of the present invention (when the post is properly/fully inserted). When the assembly of the earring post 5, sleeve 2 which the earring post 5 is inserted into, and face piece 1 holding the earring post in the sleeve, is inserted into the earlobe or body aperture, it is secured by means of a clasp used in the prior art which clasp for the present invention is made from hypo-allergenic and non-hygroscopic gold or platinum. In accordance with the present invention the clasp slides onto the tubular hollow post of the present invention in back of the earlobe to secure the present invention within the earlobe.

Note that the clasp clamping the shield merely prevents the shield from falling off the back of the user's ear. The clasp does not secure the actual earring's post which is secured only by means of one of the tongues of the face frictionally securing the actual earring post through groove 15. In this manner, the apparatus of the instant invention can be used for any earring, unlike the more restrictive invention shown in Mintorn, WO88/09134. In Mintorn the post required is of a special nature as shown therein in FIGS. 3 and 4. While a tubular sleeve or cannula is shown, no separate face piece similar to that of the instant invention is involved. Instead, an attached integral annular flange 2 prevents the allergenic earring from touching the outer-facing surface of the earlobe. The allergenic earring is "secured" to the sleeve by means of a clasp, butterfly clip or the like which mates with the groove of the allergenic earring (also see therein FIGS. 8 and 14 having a grooved sleeve and doubly attaching clip, i.e., secures posts to the groove in the sleeve and to a special groove in the special allergenic earring). Note that there is no single attachment means of securing a normal allergenic earring to a nonallergenic sleeve. Second, note that the attachment means is on the back surface (closest to the head) of the ear, not at the outer surface. Also note the closed spring ring of Mintorn FIG. 12 which must slide over a post or sleeve from behind the back ear surface to the front/outside therein which has radially inward tongues which bend, which is not at all the same as the earring vertically (assuming person standing/parallel to cross section of sleeve) snapping mechanism open face piece of the present invention even though both appear to have securing tongues. Thus, the instant invention's face serves both as a separation media (similar to the annular flange of Mintorn) as well as an easy-to-use media since it is: a) put on with a simple, usually vertical (assuming person standing) snapping motion until one of its tongues snaps into the groove on the sleeve and b) on the more easily accessible outer surface of the ear. Also, the instant invention actually secures the normal (no grooves) allergenic earring to the sleeve so neither moves in relation to each other, unlike the requirements of Mintorn.

It should be realized that the present invention is not limited to that particular embodiment and that modifications and variations may be effected therein without departing from the spirit or scope of the present invention as set out in the claims.

I claim:

1. A jewelry article to act as an effective shield against inflammation and irritation of an earlobe or other body part, having a post of an earring post therethrough, said article comprising:

(a) a sleeve, fabricated from an inert material and having a central borehole and two ends, said sleeve having an axis between said ends and adapted to be disposed in a body hole pierced through an earlobe or other body part having two sides, said sleeve comprising a tubular body having said central borehole extending substantially axially therethrough, and having a part-annular groove located near one end of said tubular body portion, said sleeve disposed in said body hole such that said groove end of said sleeve is positioned on a outer-facing side of said earlobe or body part, said sleeve is of sufficient length such that it is longer than the length of the post of the earring post to be used in association with said article to prevent any contact of said post with said earlobe or body part; and (b) a face piece fabricated from an inert material, having a plurality or inwardly-projecting radially-similar substantially resilient tongue-like elements, all of said elements joined together, two adjacent elements at a time except for one set of two adjacent elements, said face piece having one open entry path between said set of two adjacent elements which are not joined together, said path permitting access to a geometrically radially-central core aperture defined by and surrounded by said tongue-like elements, each of said elements are suitably dimensioned to, upon suitable positioning on said sleeve, permit one of said elements to enter said groove and substantially stay in the groove under a spring action of the other tongue-like elements putting pressure on a portion of the groove end of the sleeve, said portion not occupied by said groove but being substantially in a plane containing said groove, said plane being substantially perpendicular to the axis of said borehole, and wherein, after said face piece is mounted on said sleeve with one of said elements in said groove:

(i) upon suitable temporary tilting and associated pressure to said face piece having entered element in said groove, said tilting at an acute angle to the axis of said central bore hole and away from the plane substantially perpendicular to the axis of said sleeve, the post of the earring post may be easily entered into said central bore hole of said sleeve, and (ii) upon release of said pressure and return of said face piece to a plane substantially perpendicular to the axis of said sleeve, said earring post will be secured to said sleeve, and (iii) upon a similar temporary retilting of said piece, said earring post may easily be released.

2. The invention as claimed in claim 1 and further comprising a clasp made from hypoallergenic and non-hydroscopic materials, said clasp gripping the other end from said groove end of said tubular body portion, said clasp thus preventing said tubular body portion from sliding out, groove-end first, from one side of said pierced body hole.

3. A jewelry article to act as an effective shield against inflammation and irritation of an earlobe or other body aperture, said earlobe or other body aperture having an outer-facing side and an inner-facing side, said inflammation usually caused by contact of a post of an earring post with said earlobe or other body aperture, said article comprising:

(a) a sleeve fabricated from an insert material, adapted to be disposed in said body aperture pierced through the earlobe or other body part, said sleeve comprising a tubular body portion having two ends and having a central bore hole having an inner diameter, said hole extending axially substantially therethrough, said post of said earring post having a diameter less than the inner diameter of said central bore hole, and said sleeve having at least one part-annular groove located near one end of said tubular body portion, said sleeve adapted to be disposed in said body aperture such that said groove end of said sleeve is on the outer-facing side of said earlobe or other body part, said sleeve having an outside diameter and of sufficient length that said central bore hole is longer than the length of said post of said earring post to be used in association with said article, and thus to prevent any contact of said post of said earring post with said earlobe or body part; and (b) a face piece fabricated from an inert material having an outer-radial portion substantially defining a plane and an inner-radial core portion, said core comprising at least one tongue and a spring bias means, said core substantially defining and surrounding a core aperture, whereby the diameter of said core aperture is no greater than the outside diameter of said sleeve, said face piece having one open entry path leading to said core aperture, whereby upon said sleeve and said face piece being moved with respect to each other such that said sleeve enters said open entry path and then said sleeve and face piece are moved with respect to each other such that a tongue of said core of said face piece enters and rests at least partially within a said groove of said sleeve and are mechanically secured to each other by said spring bias means, and whereby said post of said earring post inserted into said bore hole is secured by said tongue, said face piece optionally temporarily tilt able to permit entry of said post of said earring post.

4. The invention of claim 3 wherein said core is indented from substantially the plane of said outer radial portion, said indented core having said at least one tongue indented, said face piece secured to said sleeve such that said indentation of said indented core faces said groove end, whereby said indented tongue, after being inserted into said groove will, (i) upon suitable tilting of said face piece, permit larger diameter earring posts than if said tongues were not indented, to enter said central bore hole of said sleeve, and (ii) upon suitable tilting of said face piece such that said outer radial portion is tilted into a plane substantially perpendicular to the axis of said central bore hole, said indented tongue will secure said post of said earring post to said sleeve.

5. The invention of claim 4 wherein only one tongue is inserted in said groove is indented.

6. The invention of claim 3 wherein said spring bias means comprises at least one tongue.

7. The invention of claim 3 wherein said spring bias means comprises two tongues.

* * * * *